US005295433A

United States Patent [19]

Malin

[11] Patent Number: 5,295,433

[45] Date of Patent: Mar. 22, 1994

[54] VALUE SELECTION MECHANISM INCLUDING MEANS FOR WEAKENING A SHAFT THEREOF

[75] Inventor: Richard A. Malin, Westport, Conn.

[73] Assignee: Pitney Bowes Inc., Stamford, Conn.

[21] Appl. No.: 85,365

[22] Filed: Jul. 2, 1993

[51] Int. Cl.[5] ..... B41L 47/46

[52] U.S. Cl. ..... 101/91; 74/424.5

[58] Field of Search ..... 101/91, 99, 106, 110, 101/111; 74/422, 424.5, 352, 353

[56] References Cited

U.S. PATENT DOCUMENTS

| | | | |
|---|---|---|---|
| 3,682,378 | 8/1972 | Rouan et al. | 101/91 |
| 3,892,355 | 7/1975 | Malavazos et al. | 101/91 |
| 4,050,374 | 9/1977 | Check, Jr. | 101/91 |
| 4,579,054 | 4/1986 | Buan et al. | 101/91 |
| 4,601,240 | 7/1986 | Sette | 101/91 |
| 4,630,210 | 12/1986 | Salazar et al. | 101/91 |
| 4,649,814 | 3/1987 | Sette | 101/110 |

*Primary Examiner*—Eugene H. Eickholt
*Attorney, Agent, or Firm*—Donald P. Walker; Melvin J. Scolnick

[57] ABSTRACT

Value selection and printing apparatus comprising, structure for printing a value, the structure including a rotatable device and a drive shaft, structure for selecting the value, the value selecting structure including a first rack gear slidably movably connected to the drive shaft, the first rack gear including a first portion of the length thereof movable internally of the device and a second portion of the length thereof movable externally of the device, the internally movable portion including a driving element, the externally movable portion including a plurality of first gear teeth formed therein the value selecting structure including a rigid guide shaft fixedly mounted within the device and an elongate second rack gear slidably connected to the guide shaft for movement therealong, the second rack gear including a driving element therefor, both rack gears' driven elements disposed in engagement, the second rack gear including a plurality of second gear teeth, the value selecting structure including a value printing wheel, the value selecting structure including a pinion gear coaxially fixedly attached to the printing wheel for rotation thereof, the pinion gear disposed in meshing engagement with the second rack gear teeth for rotation of the pinion gear and the print wheel in response to movement of the second rack gear, and structure for weakening the rigidity of the guide shaft against a force exerted against the printing wheel sufficient to disassociate the second rack gear to permit the guide shaft to bend.

7 Claims, 1 Drawing Sheet

VALUE SELECTION MECHANISM INCLUDING MEANS FOR WEAKENING A SHAFT THEREOF

This invention is generally concerned with a value selection mechanism and more particularly with a postage value selection mechanism including means for weakening a guide shaft thereof.

BACKGROUND OF THE INVENTION

U.S. Pat. No. 4,050,374 for a Meter Setting Mechanism, issued Sep. 27, 1977 to Check, Jr. and assigned to the assignee of the present invention, discloses a mechanism for selecting postage values which are to be printed by a rotary postage meter. The drive shaft of the drum includes a plurality of selectable racks, each of which is slidably movable in engagement with a different pinion gear, connected to an associated print wheel within the drum, for selectively rotating the print wheel to dispose a printing element or font thereof at the outer periphery of the drum for printing purposes. The value selection mechanism includes a first stepper motor which is operable for selecting one of the racks, and a second stepper motor which is operable for actuating the selected rack for selectively rotating the desired printing element of the associated print wheel to the printing position thereof. An electronic control system (not shown) which is coupled to a keyboard for processing postage value entries made by an operator, selectively drives the respective stepper motors in response to keyboard entries.

U.S. Pat. No. 4,630,210 for a Microprocessor Controlled D.C. Motor For Controlling A Load, issued Dec. 16, 1986 to Salazar, et. al., and assigned and the assignee of the present invention, shows a conventional postage meter including a plurality of lengthwise translatable racks mounted in channels formed in the drive shaft of a rotatable postage printing drum. The drum includes a plurality of print wheels, which are mounted for rotation in the drum, and a like number of pinion gears connected on a one-for-one basis with the print wheel. And, each of the pinion gears is disposed, on a one for one basis, in meshing engagement with each of the rack gears, so that lengthwise translation of a rack gear results in rotation of the associated print wheel to a selected position thereof wherein a printing font at the periphery of the print wheel is located for printing purposes when the drum is rotated.

U.S. Pat. No. 4,649,814 for a Rotary Selector Device, issued Mar. 17, 1987 to Sette and assigned to the assignee of the present invention, shows a rotary value selection mechanism, of the type used for selecting and driving the respective translatable racks of the aforesaid U.S. Pat. No. 4,630,210, including a first annularly-shaped rack selection member having a pinion gear mounted therewithin and movable therewith for selectively engaging the racks as the first member is rotated, and including a second annularly-shaped print-wheel-font selection member which is disposed in meshing engagement with the pinion gear teeth for translating the selected rack to move the associated print wheel as the second member is rotated.

Value selection mechanisms of the aforesaid types have from time-to-time become physically damaged such that one or more rack gears have become disassociated from its associated print wheel driving gear, with the result that the print wheels may be rotated independently thereof. Whereupon, a postage value can be printed which is different from that which has been selected by the associated, translating, rack gear. Although the occurrence of such physical damages are immediately apparent to a postage meter user, meters have been known to be continued to be used despite such a malfunction condition, in order to wrongfully print postage values without a payment being made therefor. Of course, since postage meters are required to be physically inspected on a semi-annual basis, and more frequently when Postal Service inspectors through internal postage indicia inspection controls and accounting practices suspect that a postage meter is dispensing more postage than has currently been paid for, such physical damages have a short life span due to their inevitably early discovery. Nevertheless, any postage payment losses are rightfully of great concern to the Postal Service and to postage meter manufacturers. As a result, a series of experimental activities with postage meters have been conducted to determine the basic cause, if any, of disassociation of postage selecting racks and print wheels. And, it has been experimentally determined that the majority of the instances in which such disassociations occur are due to a sufficient force being exerted against the print wheel to separate the same from the drive train therefor. Accordingly:

an object of the invention is to provide means for preventing disassociation of the rack gear and associated print wheel;

another object is to provide means for weakening the drive train, between the rack and print wheel of a value setting mechanism, against a force exerted against the print wheel which tends to separate the print wheel from the drive train; and another object is to provide rotary value selection and printing apparatus, which includes a rack gear slidably mounted on a shaft which is weakened against the exertion of a sufficient force against the print wheel to permit the shaft to bend in response to the force, with the result that the rack gear becomes jammed against slidable movement thereon.

SUMMARY OF THE INVENTION

Value selection and printing apparatus comprising, means for printing a value, the printing means including a rotatable device and a drive shaft therefor, means for selecting the value, the value selecting means including a first rack gear slidably movably connected to the drive shaft, the first rack gear including a first portion of the length thereof movable internally of the device and a second portion of the length thereof movable externally of the device, the internally movable portion including a driving element, the externally movable portion including a plurality of first gear teeth formed therein, the value selecting means including a rigid guide shaft fixedly mounted within the device and an elongate second rack gear slidably connected to the guide shaft for movement therealong, the second rack gear including a driving element therefor, the first rack gear's driven element and the second rack gear's driving element disposed in engagement, the second rack gear including a plurality of second gear teeth, the value selecting means including a value printing wheel, the printing wheel including a circumferentially-extending periphery and a plurality of printing elements located at spaced intervals thereabout, the value selecting means including a pinion gear coaxially fixedly attached to the printing wheel for rotation thereof, the pinion gear disposed in meshing engagement with the second rack gear teeth for rotation of the pinion gear and thus the print wheel in response to movement of the second rack gear, and means for weakening the rigidity of the guide shaft against a force exerted against the printing wheel which is sufficient to disassociate the second rack gear to permit the guide shaft to bend in response to the force.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
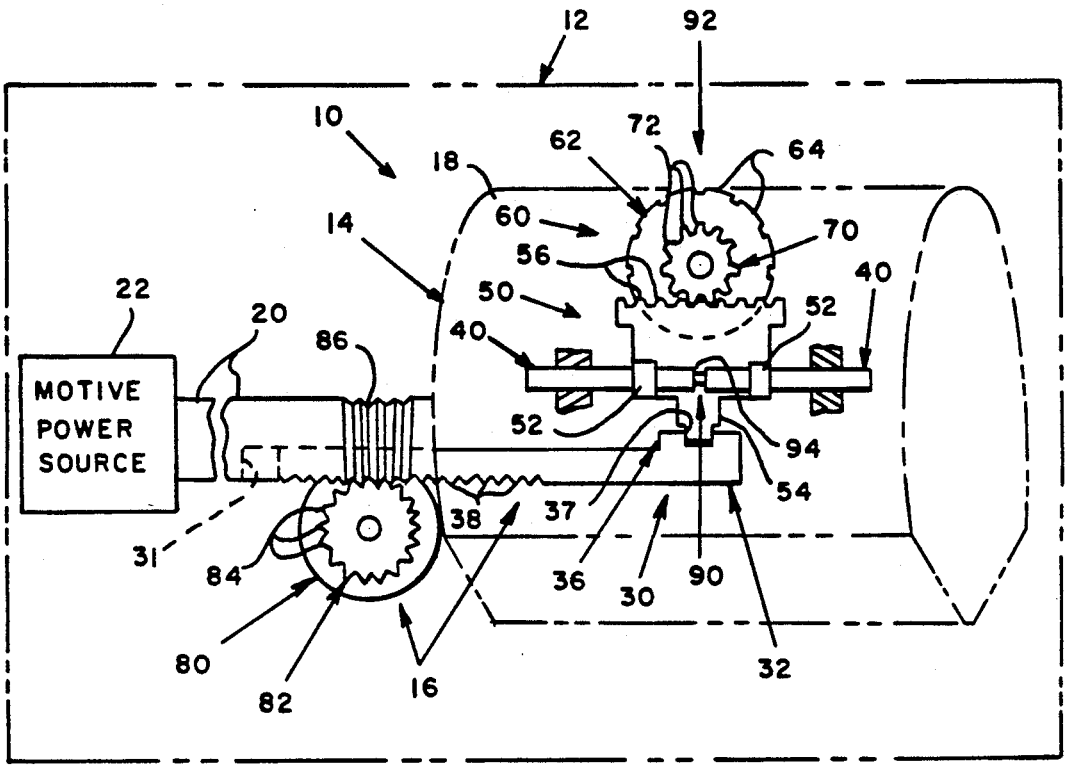
FIG. 1 is a schematic view of a rotary postage printing device, or equivalent structure, represented by a drum and a drive shaft therefor, including a value selection rack gear, print wheel and drive train therebetween, wherein the drive train includes a rack gear slidably mounted on a guide shaft.

As shown in FIG. 1, a value selection and printing mechanism 10 of the type which is used in a postage meter 12, generally includes value printing structure 14 and postage value selecting structure 16.

The postage value printing structure 14 includes a rotatable printing device or equivalent structure represented by a drum 18, and a drive shaft 20 for the drum 18. In addition, the printing structure 14 includes a conventional source of supply 22 of motive power, such as a conventional single revolution clutch or a conventional electronically controlled d.c. motor, which is suitably connected to the drive shaft 20 for rotation thereof. A more detailed description of the aforesaid typical printing structure 14 may be found in one or more of the aforesaid U.S. Pat. Nos: 4,050,374; 4,649,814; and 4,630,210; or in other U.S. Patents referred to therein.

The postage value selecting structure 16, as modified according to the invention, preferably includes an elongate, first, rack gear 30 which is conventionally slidably movably connected to the drive shaft 20, preferably as by nesting the rack gear 30 within a channel 31 formed in the drive shaft 20. The first rack gear 30 includes a first portion 32 of the longitudinal length thereof which is longitudinally movable internally of the printing drum 18, and a second portion 34 of the longitudinal length thereof, which is longitudinally movable externally of the drum 18. The internally movable portion 32 includes a driven element 36, which is preferably an element forming an aperture 37, such as a slot in the internally movable portion 32. And the externally movable portion 34 includes a plurality of first gear teeth 38 formed therein longitudinally of the length thereof. The postage value selecting structure 16 additionally includes a rigid, guide, shaft 40, which is conventionally fixedly mounted within the printing drum 18. Moreover, the postage value selecting structure 16 includes an elongate second rack gear 50, which is conventionally slidably movably connected to the guide shaft 40, preferably, as by mounting the second rack gear in sliding engagement with the guide shaft 40. In this connection, the second rack gear 50 preferably includes a pair of oppositely-spaced, substantially tubularly-shaped, supporting portions 52 thereof, which are aligned axially with one another longitudinally of the length of the second rack gear 50 and slidably mounted on the guide shaft 40 at spaced intervals therealong. The second rack gear 50 includes a driving element 54 thereof, which is preferably a tang portion extending therefrom laterally of the longitudinal length thereof. The first rack gear's driven element 36 and second rack gear's driving element 54 are preferably conventionally cooperatively configured for engagement with one another, to permit the transmission of motive power from the first to the second rack gears, 30, 50. As thus constructed and arranged the second rack gear 50 is slidably translated along the guide shaft 40 in response to translation of the first rack gear 30. In addition, the second rack gear 50 includes a plurality of second gear teeth 56 formed therein longitudinally of the length thereof. Moreover, the postage value selecting structure 16 includes a postage value printing wheel 60. The printing wheel 60 includes a circumferentially-extending periphery 62, and includes a plurality of printing elements or fonts 64 which are located at spaced intervals about the periphery 62. In the postage value printing environment herein discussed, the printing fonts 64 include, for example, the numerals 1 through 9, and include a numeral zero or graphic symbol, and a blank or period element. And, the printing elements 64 are respectively movable, in response to rotation of the print wheel 60, to a printing position externally of the postage printing drum 18. Further, the postage value selecting structure 16 preferably includes a pinion gear 70 having a plurality of circumferentially-extending gear teeth 72. The pinion gear 70 is conventionally coaxially, fixedly, attached to the value printing wheel 60 for rotation thereof in response to rotation of the pinion gear 70, and the gear teeth 72 are disposed in meshing engagement with the second rack gear teeth 56 for rotating the print wheel 60 in response to translation of the second rack gear 50 by the first rack gear 30. Still further, for translating the first rack gear 30, the postage value selection structure 16 includes conventional structure 80 for driving the first rack gear 30 including a pinion gear 82 having gear teeth 84 disposed in meshing engagement with the first rack gear teeth 38. Without departing from the spirit and scope of the invention, the driving structure 80 may be a stepper motor, d.c. motor or manually actuatable structure for driving the pinion gear 82. And, the drum drive shaft 20 includes a plurality of circumferentially-extending gear-tooth-shaped grooves 86 formed in the outer periphery thereof to permit the drum drive shaft 20 to rotate in engagement with the rack translating pinion gear 82.

Figure 2:
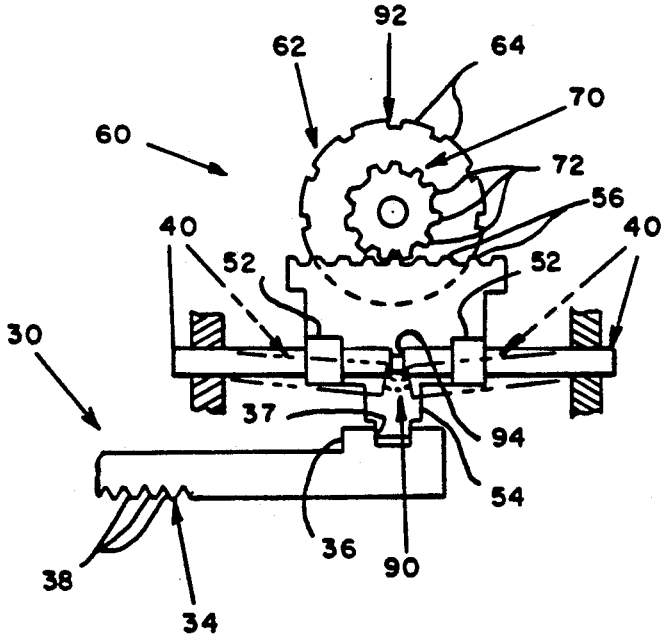
FIG. 2 is a side view of the value selection rack gear, print wheel and drive train of FIG. 1, wherein the guide shaft has been weakened against the application of a sufficient force applied to the print wheel for causing the shaft to bend in response to the force.

According to the invention, the postage value selection structure 16 (FIG. 1) preferably includes structure 90 for weakening the guide shaft 40 against the application of a force 92 exerted against the printing wheel 60 which is sufficient to disassociate the printing wheel 60 from the second rack gear teeth 56. And, more particularly, the value selection structure 70 preferably includes at least one circumferentially-extending channel 94 formed in the guide shaft 40 for weakening the rigidity of the guide shaft 40 against the application of such a force 92 to permit the guide shaft 40 to bend, as illustrated by the dashed-line presentation of the guide shaft 40 in FIG. 2, in response to the force 92, whereby the second rack gear 50 will become jammed against slidable movement thereof on the guide shaft 40.

What is claimed is:

1. Value selection and printing apparatus comprising:

a. means for printing a value, the printing means including a rotatable device and a drive shaft therefor;

b. means for selecting the value, the value selecting means including a first rack gear slidably movably connected to the drive shaft, the first rack gear including a first portion of the length thereof movable internally of the device and a second portion of the length thereof movable externally of the device, the internally movable portion including a driven element, the externally movable portion including a plurality of first gear teeth formed therein;

c. the value selecting means including a rigid guide shaft fixedly mounted within the device and an elongate second rack gear slidably connected to the guide shaft for movement therealong, the second rack gear including a driving element therefor, the first rack gear's driven element and the second rack gear's driving element disposed in engagement, the second rack gear including a plurality of second gear teeth;

d. the value selecting means including a value printing wheel, the printing wheel including a circumferentially-extending periphery and a plurality of printing elements located at spaced intervals thereabout, the value selecting means including a pinion gear coaxially fixedly attached to the printing wheel for rotation thereof, the pinion gear disposed in meshing engagement with the second rack gear teeth for rotation of the pinion gear and thus the print wheel in response to movement of the second rack gear; and e. means for weakening the rigidity of the guide shaft against a force exerted against the printing wheel which is sufficient to disassociate the printing wheel and second rack gear to permit the guide shaft to bend in response to the force.

2. The apparatus according to claim 1, wherein the guide shaft weakening means includes an annularly-extending channel formed in the guide shaft.

3. The apparatus according to claim 1, wherein the second rack gear includes oppositely spaced portions thereof slidably connected to the guide shaft at spaced intervals therealong.

4. The apparatus according to claim 3 wherein the guide shaft weakening means includes at least one annularly-extending channel formed in the guide shaft.

5. The apparatus according to claim 4, wherein the guide shaft weakening means includes a single annularly-extending channel formed in the guide shaft.

6. The apparatus according to claim 1, wherein one of the driving and driven elements includes a tang portion of one of the rack gears and the other of the driving and driven elements includes an aperture of the other of the rack gears.

7. The apparatus according to claim 6, wherein the guide shaft weakening means includes an annularly-extending channel formed in the guide shaft.

* * * * *